US010945497B2

(12) United States Patent
Catanese

(10) Patent No.: US 10,945,497 B2
(45) Date of Patent: Mar. 16, 2021

(54) ADJUSTABLE BRACELET CLASP

(71) Applicant: OMEGA SA, Biel/Bienne (CH)

(72) Inventor: Rocco Catanese, Bienne (CH)

(73) Assignee: OMEGA SA, Biel/Bienne (CH)

( * ) Notice: Subject to any disclaimer, the term of this patent is extended or adjusted under 35 U.S.C. 154(b) by 0 days.

(21) Appl. No.: 16/683,574

(22) Filed: Nov. 14, 2019

(65) Prior Publication Data

US 2020/0187605 A1 Jun. 18, 2020

(30) Foreign Application Priority Data

Dec. 13, 2018 (EP) ..... 18212449

(51) Int. Cl.
*A44C 5/24* (2006.01)

(52) U.S. Cl.
CPC ..... *A44C 5/246* (2013.01)

(58) Field of Classification Search
CPC ..... A44C 5/246; Y10T 24/2155
See application file for complete search history.

(56) References Cited

U.S. PATENT DOCUMENTS

| | | | | |
|---|---|---|---|---|
| 1,622,989 | A * | 3/1927 | Benjamin | A44C 5/246 24/71 J |
| 4,928,359 | A * | 5/1990 | Gagnebin | A44C 5/2042 24/587.11 |
| 5,485,659 | A * | 1/1996 | Kashikie | A44C 5/2052 24/265 WS |
| 8,789,245 | B2 * | 7/2014 | Leger | A44C 5/246 24/265 WS |
| 9,149,093 | B2 * | 10/2015 | Leger | A44C 5/246 |
| 9,198,485 | B2 * | 12/2015 | Kaltenrieder | A44C 5/14 |
| 9,314,073 | B2 * | 4/2016 | Kaltenrieder | A44C 5/246 |
| 9,993,051 | B2 * | 6/2018 | Kaltenrieder | A44C 5/24 |
| 10,278,460 | B2 * | 5/2019 | Catanese | A44C 5/24 |
| 2013/0286797 | A1 | 10/2013 | Leger | |
| 2018/0352914 | A1 * | 12/2018 | Vuilleme | A44C 5/246 |
| 2019/0183213 | A1 * | 6/2019 | Viller | A44C 5/18 |
| 2020/0187604 | A1 * | 6/2020 | Catanese | A44C 5/2057 |
| 2020/0187605 | A1 * | 6/2020 | Catanese | A44C 5/246 |

FOREIGN PATENT DOCUMENTS

| | | |
|---|---|---|
| CH | 704 335 A1 | 7/2012 |
| EP | 2 868 222 A1 | 5/2015 |
| EP | 3 170 420 A1 | 5/2017 |

OTHER PUBLICATIONS

European Search Report for EP 18 21 2449 dated Jun. 4, 2019.

* cited by examiner

*Primary Examiner* — Robert Sandy
*Assistant Examiner* — Louis A Mercado
(74) *Attorney, Agent, or Firm* — Sughrue Mion, PLLC

(57) ABSTRACT

A bracelet clasp, of a deployant buckle type, is provided. The bracelet clasp includes first and second strips articulated to one another, between a closed position for wear and an open position, the first strip carrying a member for attaching a first bracelet strand, the second strip including, at its second end, a length adjustor for adjusting the length of the bracelet, the clasp further includes at least one locking member for holding the first and second strips in their closed position. According to an embodiment, the length adjustor includes a bar movable relative to the second strip and carrying a stud intended to be inserted into a hole in the bracelet to define a point of anchoring of the latter to the clasp, the movable bar being able to move and define at least two positions associated with a useful length of the bracelet.

14 Claims, 2 Drawing Sheets

ADJUSTABLE BRACELET CLASP

CROSS-REFERENCE TO RELATED APPLICATIONS

This application claims priority to European Patent Application No. 18212449.5, filed on Dec. 13, 2018, the entire contents of which are incorporated herein by reference.

FIELD OF THE INVENTION

The invention concerns a clasp, particularly a bracelet clasp, of the deployant buckle type, comprising first and second strips articulated to each other by a first of their respective ends, between a closed position for wear, and at least one open position, said first strip carrying a member for attaching a first bracelet strand, said second, lower strip carrying at its second end means for adjusting the length of the bracelet, the clasp further comprising at least one locking member for holding said first and second strips in their closed position.

The present invention also concerns a wristwatch provided with such a clasp.

STATE OF THE ART

The problem of the need to provide a device for adjusting the useful length of a bracelet is well known.

On the one hand, in the case of bracelets formed of links, it is possible that the circumference of the user's wrist has a value that lies between two configurations of the bracelet differing from each other by a single link. Thus, it is useful to provide a device for adjusting the useful length of the bracelet that allows a finer adjustment of the bracelet length than removal or addition of a link.

Further, it is also known that the value of the wrist circumference varies with season, a maximum value generally being reached in summer and a minimum value being reached in winter. Here too, it is preferable to provide a device for fine adjustment of the useful length of the bracelet that allows the wearer of the bracelet to adjust the length to improve the wear comfort of the bracelet.

By way of example, EP Patent Application No. 09131060A1 discloses a clasp with a deployant buckle having a cover with a series of pairs of holes intended to accommodate the ends of a bracelet attachment bar. Two adjacent pairs of holes are separated by a distance defining an adjustment step of the useful bracelet length, to answer the aforementioned problems.

However, this type of bracelet length adjustment device is unattractive given that the adjustment holes are visible on the sides of the cover. Further, the operation to adjust this type of clasp requires some dexterity since it requires inserting a pointed tool into the holes to compress the bracelet attachment bar, which risks causing damage to the cover in case of clumsiness by the person performing the adjustment.

To avoid this situation, alternative devices have already been disclosed, such as for example in EP Patent No 0350785 B1 which discloses a clasp similar to the above but comprising, alternatively, a device for adjusting the useful length of the bracelet that can be operated without using a tool. Indeed, the clasp disclosed in this Patent is of the deployant buckle type having two strips articulated to each other by means of a pin that passes through both, each of the strips carrying at its free end a member for attachment to a bracelet. A first strip bears a hook intended to be engaged in a hole arranged in the second strip to cooperate therein with a spring catch that enables the hook, and thus the clasp, to be locked in a closed state. The second strip comprises two parts able to slide in relation to one another within a certain predefined range, defining an adjustment step of the useful length of the bracelet. A first of these two parts bears the hinge connecting it to the first strip, while the second part bears the locking spring catch. The hole in which the hook engages to lock the clasp has a length, in the longitudinal direction of the bracelet, corresponding to the sliding range between the two parts of the second strip. The spring catch has a central part defining two positions for the hook in the longitudinal direction of the bracelet that correspond to two different useful lengths of the bracelet. A control member comprising, in particular, a push-piece, actuates the spring catch to release the hook and open the clasp.

It should be noted that one drawback which results from this structure is the loss of the bracelet length adjustment each time that the clasp is opened. Consequently, each time the clasp is closed, the wearer of the bracelet must ensure that the hook is inserted on the side of the central portion of the spring catch corresponding to the desired bracelet length.

Adjustment devices comprising a specific locking member have also been proposed, by way of alternative, to avoid this type of drawback.

SUMMARY OF THE INVENTION

It is a main object of the present invention to overcome the drawbacks of known prior art clasps, by proposing a bracelet clasp comprising a device for adjusting the useful length of a bracelet which has a simple structure, preferably offering stable adjustment, including when the clasp is open, and which is easy to operate.

To this end, the present invention more particularly concerns a bracelet clasp of the deployant buckle type, including first and second strips articulated to each other, by a first of their respective ends, between a closed position for wear, and at least one open position, said first strip carrying a member for attaching a first bracelet strand, said second, lower strip having, at its second end, means for adjusting the length of the bracelet, the clasp further comprising at least one locking member for holding said first and second strips in their closed position.

According to the invention, said length adjustment means comprise a bar movable in translation relative to the second strip and carrying a stud intended to be inserted into a suitable hole in the bracelet strand to define a point of anchoring of the latter to the clasp, the movable bar being able to be moved via pushers mounted on the second strip and thus to define at least two predefined positions associated with a predefined useful length of the bracelet.

Generally speaking, each of the positions can advantageously be defined by a hole, which is arranged in the loop and in which the stud can be partially engaged.

In accordance with other advantageous variants of the invention:

- the second strip comprises two curved portions each having a recess for receiving a pusher arranged to act on the movable bar;
- each curved portion has a guide groove arranged to receive one end of the movable bar;
- the guide groove comprises at each of its ends at least two circular spaces defining two distinct positions of the bar;

the circular spaces have a diameter substantially identical to that of the ends of the bar, and greater than the width of the groove;

the pushers include a stop of substantially identical dimensions to the guide groove, arranged to act on the bar;

the guide groove has two successive portions in the thickness of the curved portion, a first portion comprising the groove and the two circular spaces and a second portion in the form of an oblong space machined on the back of the groove;

the bar is of rectangular cross-section and each curved portion has a shoulder arranged to guide the bar in translation.

The invention also concerns a wristwatch including a bracelet or wristband provided with a clasp according to the invention.

BRIEF DESCRIPTION OF THE DRAWINGS

Other features and advantages of the present invention will appear more clearly upon reading the following detailed description of a preferred embodiment, made with reference to the annexed drawings, given by way of non-limiting example and in which.

EMBODIMENT(S) OF THE INVENTION

Figure 1:
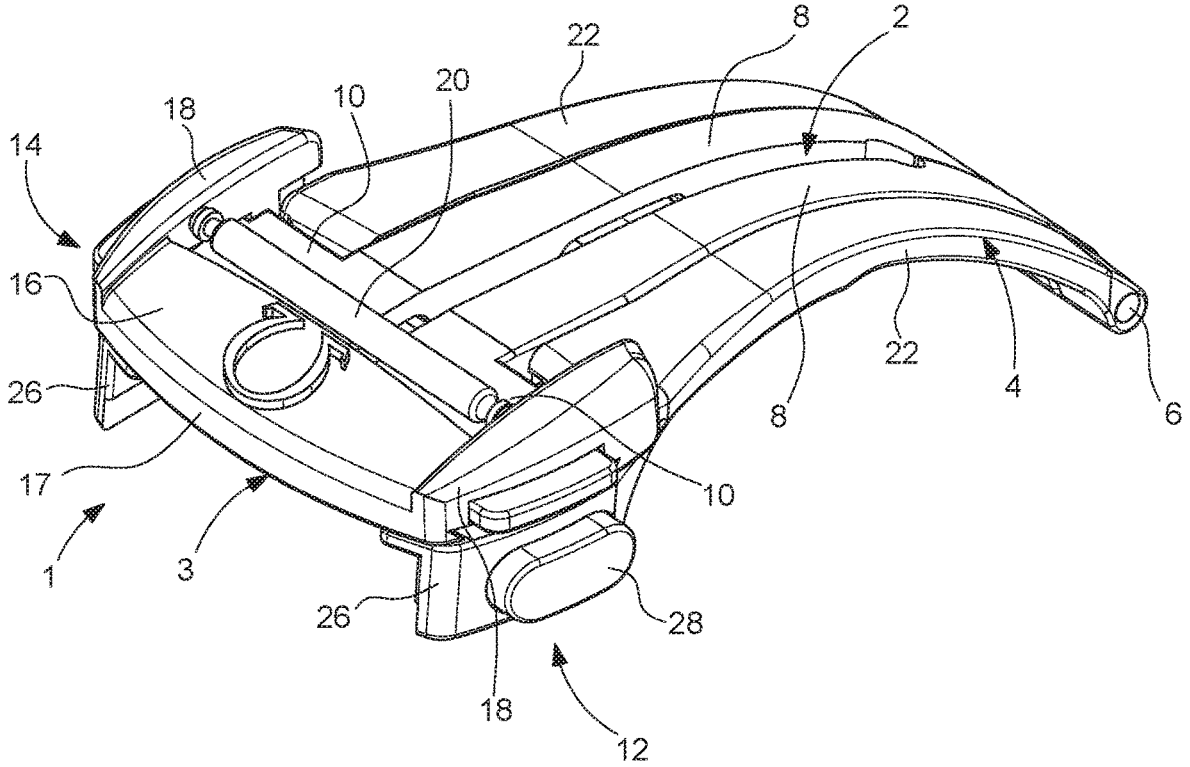
FIG. 1 represents a simplified, perspective overview of a bracelet clasp according to a preferred embodiment of the present invention, where the clasp is closed and illustrated from a first side.
Figure 2:
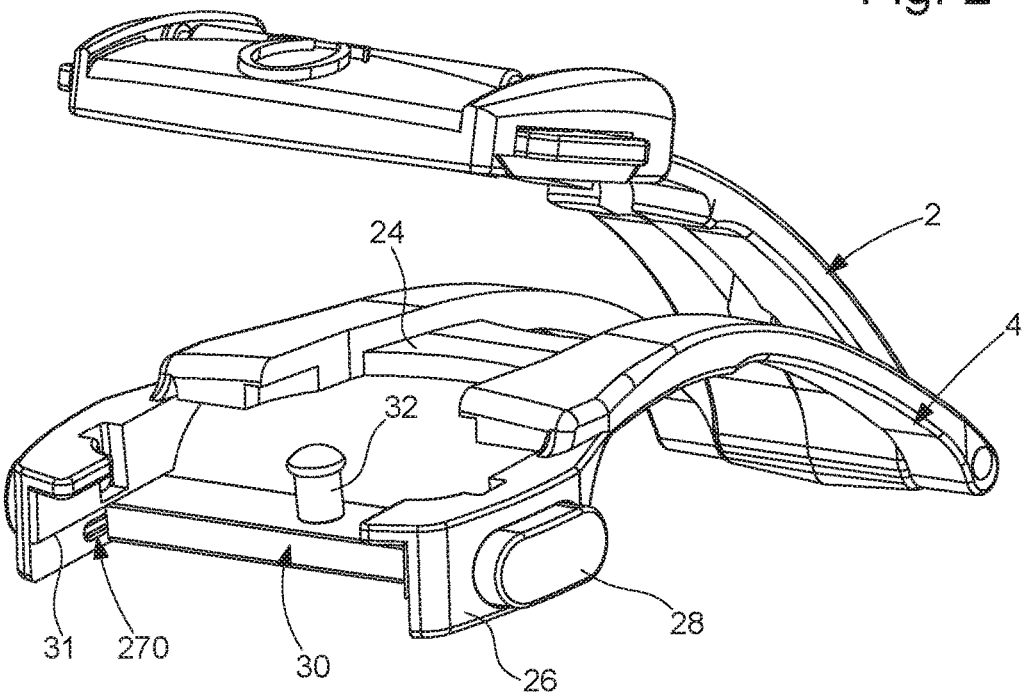
FIG. 2 represents a perspective view of the clasp of FIG. 1, illustrated in an open position.

The clasp illustrated in a non-limiting manner in the Figures is a preferred embodiment of the invention. More specifically, clasp 1 is of the deployant buckle type and is intended to close a timepiece bracelet or strap.

As represented in the Figures, clasp 1 includes a first strip 2 articulated on a second strip 4 by means of a pin 6 associated with a socket, in a non-limiting illustrative manner. Each of the strips has an elongated shape in the longitudinal direction of the bracelet and is slightly curved to better match the shape of a wearer's wrist.

First strip 2 includes two branches 8 arranged in contact with each other at the end thereof located on the side of pin 6, and each having a cut away portion so that said branches are not in contact with each other over most of their length.

Figure 3:
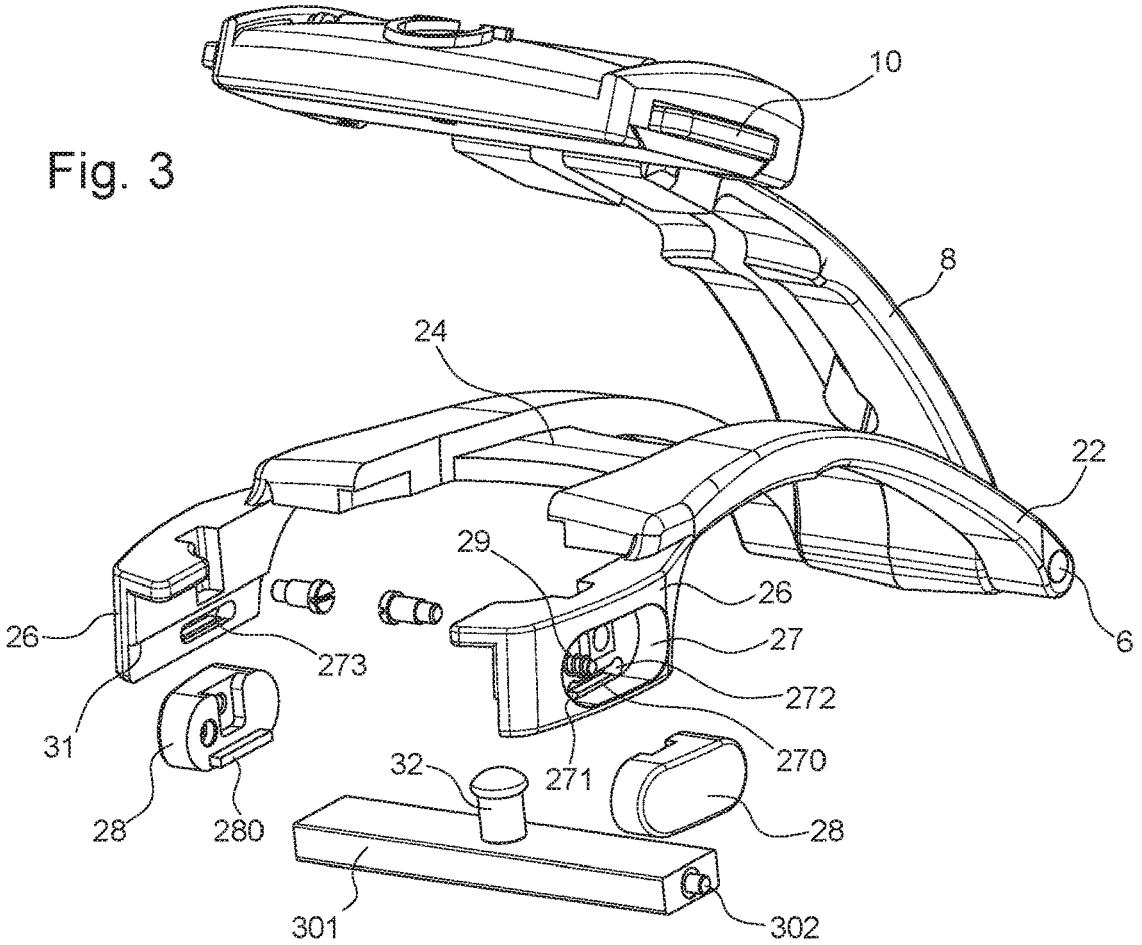
FIG. 3 represents a partially exploded perspective view of the clasp of FIG. 2.
Figure 4:
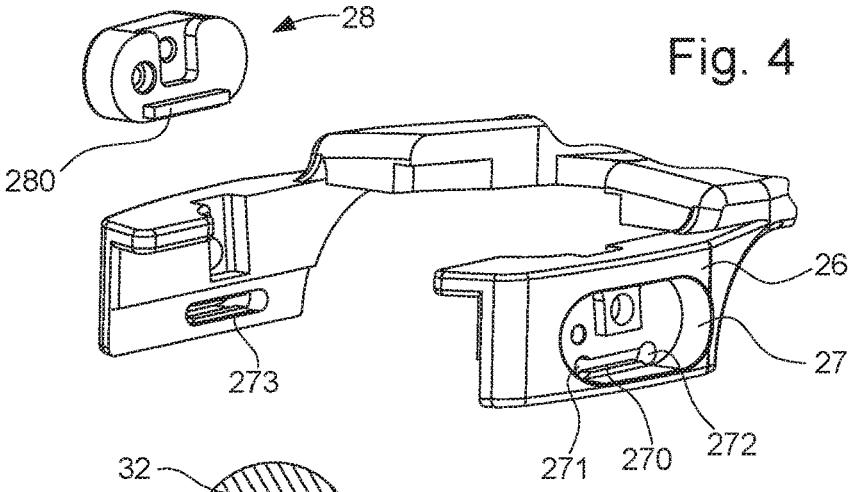
FIG. 4 represents a detailed perspective view of the means for adjusting the length of the bracelet.
Figure 5:
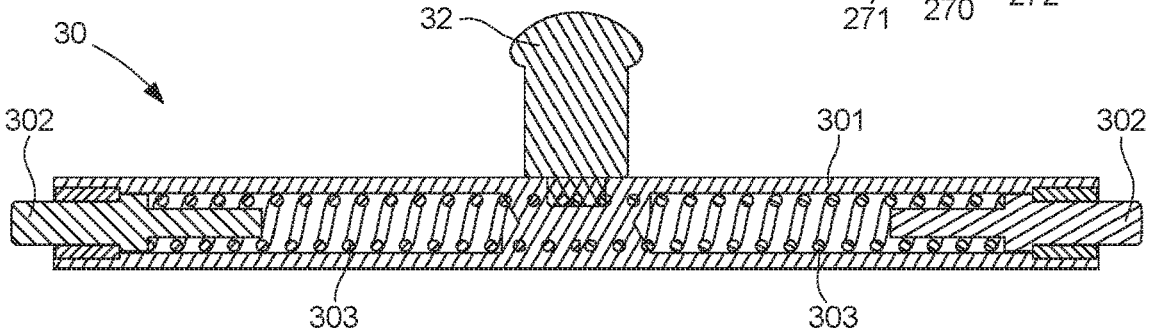
FIG. 5 represents a sectional view of a movable bar of a clasp according to the invention.

Each of branches 8 carries an extension portion 10, in proximity to its end farthest from pin 6, extending in a direction perpendicular to the longitudinal direction of the bracelet, to form a pusher, defining a control member for unlocking the clasp, as shown in FIG. 3.

The first strip 2 also has a cover 14 having an upper wall 16 carrying side walls 18, and a lower wall 17. Side walls 18 are provided with two holes for housing one end of a bar 20 for attaching a bracelet strand, in a conventional manner. Side walls 18 also comprise two recesses allowing extension portions 10 to extend and thus making it possible to unlock clasp 1.

The second strip 4 includes two arms 22 connected by a cross member 24 in their central area. Arms 22 are extended by curved portions 26 defining a passage 3 for another bracelet strand.

Further, the free end of second strip 4 carries a device for adjusting the useful length of the bracelet, intended to be associated with clasp 1.

The device for adjusting the useful length of the bracelet comprises a movable bar 30 of rectangular shape and formed in a conventional manner by a body 301, two pivots 302 arranged in body 301 and two springs 303 placed in hollow body 301, supported between the pivots and the central part of body 301, the two pivots being able to slide in a respective end of body 301.

Advantageously, movable bar 30 is provided with a stud 32 intended to be engaged in a hole in the bracelet strand to define a point of anchoring of the latter to clasp 1. Thus, movable bar 30 makes it possible to move the position of the anchoring point of the bracelet on the clasp and thus the length of the bracelet for wear. Stud 32 is in the form of a screw-foot here and is preferably pressed into bar 30.

Naturally, other similar structures can be envisaged for mounting stud 32 on bar 30, without departing from the scope of the invention. By way of example, the bar could be arranged to have a threaded hole while the stud has an outer thread suitable for it to be screwed directly into the hole, those skilled in the art could also press fit and braze the stud or make the assembly by injection moulding or by machining in the mass.

According to the invention, each curved portion 26 has a recess 27 intended to receive a pusher 28, each being arranged to cooperate with a pivot of movable bar 30 when the wearer of the watch presses on the pushers.

As illustrated in FIG. 3, each recess 27 has a guide groove 270 arranged to receive a pivot 302 of movable bar 30, guide groove 270 having at each end thereof at least two circular spaces 271, 272 to define two distinct positions of bar 30, a short position and a long position. Those skilled in the art will evidently know how to adapt the invention to obtain more than two positions if necessary.

Circular spaces 271, 272 have a diameter substantially identical to that of pivots 302 of bar 30, and greater than the width of the groove in order to avoid any undesired movement of the bar.

Advantageously, pushers 28 include a stop 280 of substantially identical dimensions to that of guide groove 270 on their inner face, i.e. the face opposite the handling face, which is arranged to act on pivots 302 of bar 30 and retract them, and thus allow movable bar 30 to move between the two distinct positions.

As can be observed in FIG. 3, guide groove 270 has two successive portions in the thickness of curved portion 26, a first portion including groove 270 and the two circular spaces 271, 272 and a second portion in the form of an oblong space 273 on the back of groove 270 to allow the guidance of pivots 302 of bar 30 when pushers 28 are pressed.

A spring 29 is placed between the pusher and the bottom of recess 27 in order to hold it in its rest position. To obtain a simple structure, spring 29 is associated with a positioning pin and a retaining screw for the assembly thereof to the clasp.

It will also be noted that each curved portion 26 includes a shoulder 31 intended to guide bar 30 in its movement and prevent any tilting thereof.

Thus, when the wearer wishes to change the bracelet length, the wearer can change the position of stud 32 by simultaneously pressing both pushers 28, and then moving the strand integral with bar 30 via stud 32 from one position to another. Once the position is chosen, the wearer releases pushers 28 and the position is locked.

In order to limit the dimensions of the clasp, the space between arms 22 of second strip 4 defines a recess for accommodating first strip 2 in the closed state of clasp 1, in a known manner.

Conventional locking means are provided for holding the clasp in the closed state. To this end, a conventional locking mechanism is arranged to keep first strip 2 locked on second strip 1 when pressure is not simultaneously exerted on the pushers formed by extension portions 10. Extension portions 10 each have fixed hooks configured to cooperate respectively with hooks disposed on arms 22 of second strip 4.

When extension portions 10 are actuated, the hooks move away from each other to change the clasp into its open state.

It is evident from the present description that the clasp according to the present invention includes a bar with a stud able to be moved to adjust the useful length of the bracelet. The design and operation of this stud are simple and enable the user to easily adjust the clasp when necessary.

The above description endeavours to describe a particular embodiment by way of non-limiting illustration and the invention is not limited to the implementation of certain particular features that have just been described such as, for example, the specifically illustrated shapes described for the strips or their mode of cooperation for locking the clasp.

Those skilled in the art will not encounter any particular difficulty in adapting the content of the present disclosure to their own requirements and in implementing a clasp, in particular for a timepiece, without departing from the scope of the invention. It will be noted, for example, that adapting the teaching herein to the design of a deployant buckle with a different structure from that illustrated and described here will not cause any particular difficulty for those skilled in the art.

Moreover, the clasp according to the present invention is not limited to the implementation of two positions for the bar. Indeed, those skilled in the art will also not encounter any particular difficulty in adapting the teaching herein to the implementation of a clasp having a greater number of possible adjustment positions.

The invention claimed is:

1. A bracelet clasp of a deployant buckle type, for a bracelet, the bracelet clasp comprising:

first and second strips configured to be articulated to each other, by a first of their respective ends, between a closed position for wear, and at least one open position;

a length adjustment means for adjusting a length of the bracelet, the length adjustment means provided at a second end of said second strip; and at least one locking member for holding said first and second strips in their closed position, wherein said first strip carries a member for attaching a bracelet strand, said length adjustment means comprises a movable bar movable in translation relative to the second strip and which carries a stud intended to be inserted into a suitable hole in the bracelet strand to define a point of anchoring of the bracelet strand to the bracelet clasp, the movable bar being able to be moved via pushers mounted on the second strip and thus to define at least two predefined positions associated with respective predefined lengths of the bracelet, and the movable bar comprises:

a rectangular body, pivots provided at respective ends of the rectangular body and configured to slide into the respective ends of the rectangular body, a first spring supported, within the rectangular body, between one of the pivots and a central part of the rectangular body, and a second spring supported, within the rectangular body, between another one of the pivots and the central part of the rectangular body.

2. The bracelet clasp according to claim 1, wherein the bracelet clasp is configured to be a part of a wristwatch by attaching to the bracelet.

3. The bracelet clasp according to claim 1, characterized in that the second strip comprises two curved portions each having a recess for receiving one of the pushers, which are arranged to act on a respective one of the pivots of the movable bar.

4. The bracelet clasp according to claim 3, characterized in that the movable bar is of rectangular cross-section and in that each of the curved portions has a shoulder arranged to guide the movable bar in translation.

5. The bracelet clasp according to claim 3, characterized in that each of the two curved portions includes a guide groove arranged to receive one end of the movable bar.

6. The bracelet clasp according to claim 5, characterized in that one from among at least two circular spaces, defining two distinct positions of the movable bar, is provided at each end of the guide groove.

7. The bracelet clasp according to claim 5, characterized in that the pushers include a stop of substantially identical dimensions to the guide groove arranged to act on the movable bar.

8. The bracelet clasp according to claim 6, characterized in that the at least two circular spaces have a diameter substantially identical to that of the pivots of the movable bar, and greater than a width of the guide groove.

9. The bracelet clasp according to claim 6, characterized in that two successive portions in a thickness direction of each of the curved portions is provided, the two successive portions including a first portion comprising the guide groove and the at least two circular spaces, and a second portion comprising an oblong space provided on a back of the guide groove.

10. A bracelet clasp of a deployant buckle type, for a bracelet, the bracelet clasp comprising:

first and second strips configured to be articulated to each other, by a first of their respective ends, between a closed position for wear and at least one open position;

a length adjustment means for adjusting a length of the bracelet, the length adjustment means provided at a second end of said second strip; and at least one locking member for holding said first and second strips in their closed position, wherein said first strip carries a member for attaching a bracelet strand, said length adjustment means comprises a movable bar movable in translation relative to the second strip and which carries a stud intended to be inserted into a suitable hole in the bracelet strand to define a point of anchoring of the bracelet strand to the bracelet clasp, the movable bar being able to be moved via pushers mounted on the second strip and thus to define at least two predefined positions associated with respective predefined lengths of the bracelet, the second strip comprises two curved portions each having a recess for receiving one of the pushers arranged to act on the movable bar, and each of the two curved portions include a guide groove arranged to receive one end of the movable bar.

11. The bracelet clasp according to claim 10, characterized in that one from among at least two circular spaces, defining two distinct positions of the movable bar, is provided at each end of the guide groove.

12. The bracelet clasp according to claim 10, characterized in that the pushers include a stop of substantially identical dimensions to the guide groove arranged to act on the movable bar.

13. The bracelet clasp according to claim 11, characterized in that the at least two circular spaces have a diameter substantially identical to that of ends of the movable bar, and greater than a width of the guide groove.

14. The bracelet clasp according to claim 11, characterized in that two successive portions in a thickness direction of each of the curved portions is provided, the two successive portions including a first portion comprising the guide groove and the at least two circular spaces, and a second portion comprising an oblong space provided on a back of the guide groove.

* * * * *